US010262825B2

(12) United States Patent
Song et al.

(10) Patent No.: US 10,262,825 B2
(45) Date of Patent: Apr. 16, 2019

(54) MOVING IRON CORE GUIDE MECHANISM FOR HIGH VOLTAGE DIRECT CURRENT RELAY

(71) Applicant: ZHEJIANG INNUOVO NEW ENERGY TECHNOLOGY CO., LTD., Dongyang, Zhejiang Province (CN)

(72) Inventors: Wenrong Song, Dongyang (CN); Rongai Yu, Dongyang (CN); Haiyan Huang, Dongyang (CN); Xiaobin Guo, Dongyang (CN); Dejin Du, Dongyang (CN); Peng Su, Dongyang (CN)

(73) Assignee: ZHEJIANG INNUOVO NEW ENERGY TECHNOLOGY CO., LTD., Dongyang (CN)

( * ) Notice: Subject to any disclaimer, the term of this patent is extended or adjusted under 35 U.S.C. 154(b) by 96 days.

(21) Appl. No.: 15/540,920

(22) PCT Filed: Jul. 7, 2016

(86) PCT No.: PCT/CN2016/089175

§ 371 (c)(1),
(2) Date: Jun. 29, 2017

(87) PCT Pub. No.: WO2017/107455

PCT Pub. Date: Jun. 29, 2017

(65) Prior Publication Data

US 2018/0025873 A1 Jan. 25, 2018

(30) Foreign Application Priority Data

Apr. 29, 2016 (CN) ..... 2016 1 0276494

(51) Int. Cl.
*H01H 50/36* (2006.01)
*H01H 50/18* (2006.01)
(Continued)

(52) U.S. Cl.
CPC ..... *H01H 50/18* (2013.01); *H01H 50/36* (2013.01); *H01H 50/546* (2013.01); *H01H 50/641* (2013.01); *H01F 2007/083* (2013.01)

(58) Field of Classification Search
CPC ..... H01F 50/36–50/42; H01F 50/546; H01F 2007/083
(Continued)

(56) References Cited

U.S. PATENT DOCUMENTS 3,815,060 A * 6/1974 Turnbull ..... H01H 50/546 335/131

* cited by examiner

*Primary Examiner* — Ramon M Barrera
(74) *Attorney, Agent, or Firm* — Jiwen Chen

(57) ABSTRACT

The present invention discloses a moving iron core guide mechanism for an HVDC relay, comprising a pushrod, an upper section of the pushrod being located above a yoke plate and fixed with a moving contact assembly, a middle section and a lower section of the pushrod passing through the yoke plate downward, the middle section of the pushrod being fixed with a moving iron core; the moving iron core is located inside a magnetic conductive cylinder of a U-shaped yoke; a lower bushing is fixed inside the magnetic conductive cylinder, and the lower bushing is located below the moving iron core; a lower guide hole running from top to bottom is formed on the lower bushing; and the lower section of the pushrod is always fitted inside the lower guide hole of the lower bushing, and the pushrod is in smooth contact with an inner wall of the lower guide hole. In the present invention, the up-and-down motion of the moving iron core and the pushrod can become easier while the turns of the coil can be maintained; and the production cost can be reduced when the moving iron core and the pushrod are in normal use.

9 Claims, 2 Drawing Sheets

(51) Int. Cl.
*H01H 50/54* (2006.01)
*H01H 50/64* (2006.01)
*H01F 7/08* (2006.01)

(58) Field of Classification Search
USPC ..... 335/132
See application file for complete search history.

MOVING IRON CORE GUIDE MECHANISM FOR HIGH VOLTAGE DIRECT CURRENT RELAY

This is a U.S. national stage application of PCT Application No. PCT/CN2016/089175 under 35 U.S.C. 371, filed Jul. 7, 2016 in Chinese, claiming priority of Chinese Application No. 201610276494.5, filed Apr. 29, 2016, all of which are hereby incorporated by reference.

TECHNICAL FIELD OF THE INVENTION

The present invention relates to a high voltage direct current (HVDC) relay and in particular to a moving iron core guide mechanism for an HVDC relay.

BACKGROUND OF THE INVENTION

After an HVDC relay is powered, a pushrod fixed on a moving iron core might radially deflect toward a magnetic conductive cylinder due to a magnetic force. That is, a certain included angle is generated between an axis of the pushrod and an axis of the magnetic conductive cylinder, and thus a certain included angle is also generated between an axis of the moving iron core and an axis of the magnetic conductive cylinder. As a result, when the moving iron core and the pushrod are moving upward and downward, a frictional force between the two and an inner wall of the magnetic conductive cylinder is increased. On one hand, the sensibility of the relay will be decreased, resulting in delayed response. On the other hand, the power consumption of the relay will be increased, and the relay will even be burned out.

SUMMARY OF THE INVENTION

An object of the present invention is to provide a moving iron core guide mechanism for an HVDC relay, which is capable of improving the sensibility of a relay, reducing the power consumption of a relay, prolonging the service life of a relay and reducing the manufacturing cost.

To achieve the purpose mentioned above, the present invention adopts the following technical solution. A moving iron core guiding mechanism for an HVDC relay is provided, comprising a pushrod, an upper section of the pushrod being located above a yoke plate and fixed with a moving contact assembly, a middle section and a lower section of the pushrod passing through the yoke plate downward, the middle section of the pushrod being fixed with a moving iron core; the moving iron core is located inside a magnetic conductive cylinder of a U-shaped yoke; a lower bushing is fixed inside the magnetic conductive cylinder, and the lower bushing is located below the moving iron core; a lower guide hole running from top to bottom is formed on the lower bushing; and the lower section of the pushrod is always fitted inside the lower guide hole of the lower bushing, and the pushrod is in smooth contact with an inner wall of the lower guide hole.

In the present invention, by the arrangement of a lower bushing inside the magnetic conductive cylinder, the lower section of the pushrod is always fitted inside a lower guide hole of the lower bushing, so that there is no radical deflection during the up-and-down motions of the moving iron core and the pushrod. In this way, the coaxiality among the moving iron core, the pushrod and the magnetic conductive cylinder is promised, so as to reduce the frictional force between the moving iron core and the magnetic conductive cylinder and the frictional force imposed on the pushrod. Accordingly, a moving reed fixed with the pushrod can move quickly in response to ON and OFF actions of the relay, and the sensibility of the relay is thus improved, resulting in in-time response. In addition, the reduction of the frictional force also reduces the power consumption of the relay and lowers the requirements on the turns of the coil, and the manufacturing cost of the relay is thus reduced.

Preferably, the lower bushing has a frustum structure in which the diameter of its upper end is greater than that of its lower end; an external diameter of an upper end of the lower bushing is less than an internal diameter of the magnetic conductive cylinder; an external diameter of a lower end of the lower bushing is greater than the internal diameter of the magnetic conductive cylinder; and the lower bushing is fitted inside the magnetic conductive cylinder from bottom to top. By using the lower bushing having a frustum structure, it is convenient to assemble the lower bushing into the magnetic conductive cylinder and reliably locate the lower bushing.

Preferably, a hollow cavity is formed in a lower-half portion of the lower bushing; the lower guide hole is communicated with the hollow cavity; and a plurality of longitudinally telescopic chutes are provided on a wall of the hollow cavity, so that the lower bushing can be retractable inside the magnetic conductive cylinder; and when the lower bushing is mounted on a predetermined position, the lower bushing can be defined inside the magnetic conductive cylinder, thus achieving quick assembly of the lower bushing.

Preferably, the plurality of longitudinally telescopic chutes are evenly distributed at intervals along the circumferential direction of the lower bushing, so that all parts on the lower-half section of the lower bushing are consistent in retraction, thus ensuring the coaxiality between a lower guide hole of the lower bushing and the pushrod.

Preferably, a through hole for the pushrod to pass through is formed on the yoke plate, an upper bushing is fixed inside the through hole, an upper guide hole running from top to bottom is formed on the upper bushing, and the pushrod is in smooth contact with an inner wall of the upper guide hole. By guiding the two ends of the pushrod on the moving iron core by the upper bushing and the lower bushing, the deflection of the moving iron core and the pushrod is further prevented.

Preferably, at least three convex ribs protruding outward are formed on an external wall of the upper bushing, and the convex ribs are arranged in a longitudinal direction and are parallel to an axis of the upper bushing; and the convex ribs are evenly distributed at intervals on the external wall of the upper bushing along the circumferential direction of the upper bushing. Convex ribs with a certain thickness facilitate mutual fixation between the upper bushing and the through hole of the yoke plate, so that the upper bushing can be clamped inside the through hole. For the convenience of arranging the upper bushing, the convex ribs should not be too thick.

Preferably, the upper bushing comprises an upper portion, a middle portion and a lower portion of the upper bushing, the convex ribs are arranged on an external wall of the middle portion of the upper bushing, and the lower portion of the upper bushing has a frustum structure in which the diameter of its upper end is greater than that of its lower end. The arrangement of the lower portion of the bushing makes it easier to fit the upper bushing inside the through hole of the yoke plate.

Preferably, the upper portion of the upper bushing has an annular structure in which the diameter of the upper portion is greater than that of the middle portion thereof.

Preferably, a longitudinal cross-section of the axis of the moving iron core is H-shaped; an upper moving iron core cavity is formed at an upper end of the iron moving core, and a lower moving iron core cavity is formed at a lower end of the moving iron core; the upper moving iron core cavity penetrates through the moving iron core upward, and the lower moving iron core cavity penetrates through the moving iron core downward; there is a pushrod fixing portion between the upper moving iron core cavity and the lower moving iron core cavity; and the pushrod and the pushrod fixing portion are fixed by threads. The above arrangement can reduce the manufacturing cost of the moving iron core.

In the present invention, the up-and-down motion of the moving iron core and the pushrod can become easier while the turns of the coil can be maintained; and the production cost can be reduced when the moving iron core and the pushrod are in normal use.

DETAILED DESCRIPTION OF THE INVENTION

Figure 1:
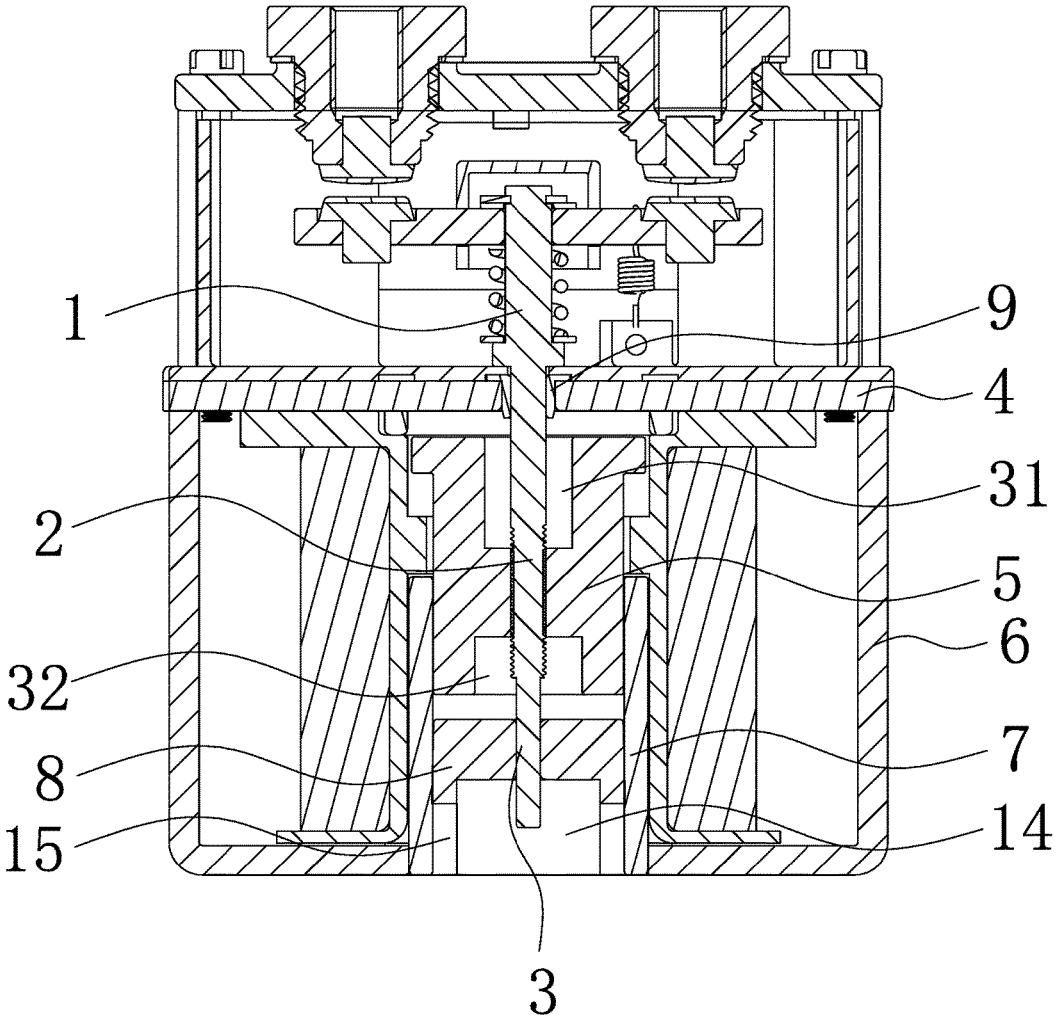
FIG. 1 is a sectional view of the present invention.

As shown in FIG. 1, the present invention provides a moving iron core guide mechanism for an HVDC relay, comprising a pushrod which comprises an upper section 1, a middle section 2 and a lower section 3, an upper section 1 of the pushrod being located above a yoke plate 4 and fixed with a moving contact assembly, a middle section 2 and a lower section 3 of the pushrod passing through the yoke plate 4 downward, the middle section 2 of the pushrod being fixed with a moving iron core 5; the moving iron core 5 is located inside a magnetic conductive cylinder 7 of a U-shaped yoke 6; a lower bushing 8 is fixed inside the magnetic conductive cylinder 7, and the lower bushing 8 is located below the moving iron core 5; a lower guide hole 11 running from top to bottom is formed on the lower bushing 8; and the lower section 3 of the pushrod is always fitted inside the lower guide hole 11 of the lower bushing 8, and the lower section 3 of the pushrod is in smooth contact with an inner wall of the lower guide hole 11.

Figure 2:
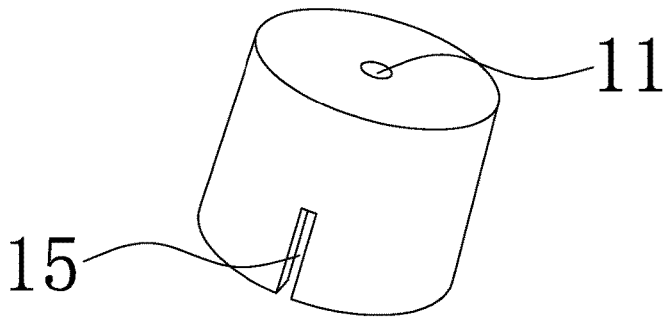
FIG. 2 is a structure diagram of a lower bushing according to the present invention.
Figure 3:
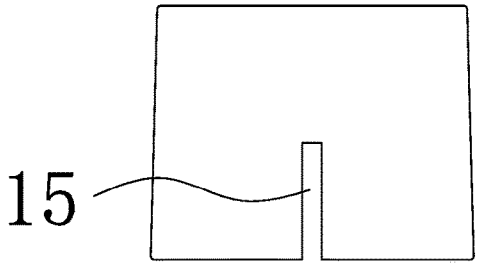
FIG. 3 is another structure diagram of a lower bushing according to the present invention.

As shown in FIG. 1, FIG. 2 and FIG. 3, the lower bushing 8 has a frustum structure in which the diameter of its upper end is greater than that of its lower end; an external diameter of an upper end of the lower bushing 8 is less than an internal diameter of the magnetic conductive cylinder 7; an external diameter of a lower end of the lower bushing 8 is greater than the internal diameter of the magnetic conductive cylinder 7; and the lower bushing 8 is fitted inside the magnetic conductive cylinder 7 from bottom to top. The conical degree of the frustum structure of the lower bushing 8 can be arranged as desired, so as to be adapted to relays of different types and sizes.

A hollow cavity 14 is formed in a lower-half portion of the lower bushing 8, the lower guide hole 11 is communicated with the hollow cavity 14, and three telescopic chutes 15 arranged longitudinally are provided on a wall of the hollow cavity 14; the telescopic chutes penetrate through the lower bushing 8 downward; the cavity 14 penetrates through the lower bushing 8 downward; and the three telescopic chutes 15 are evenly arranged at intervals along the circumferential direction of the lower bushing 8.

Figure 4:
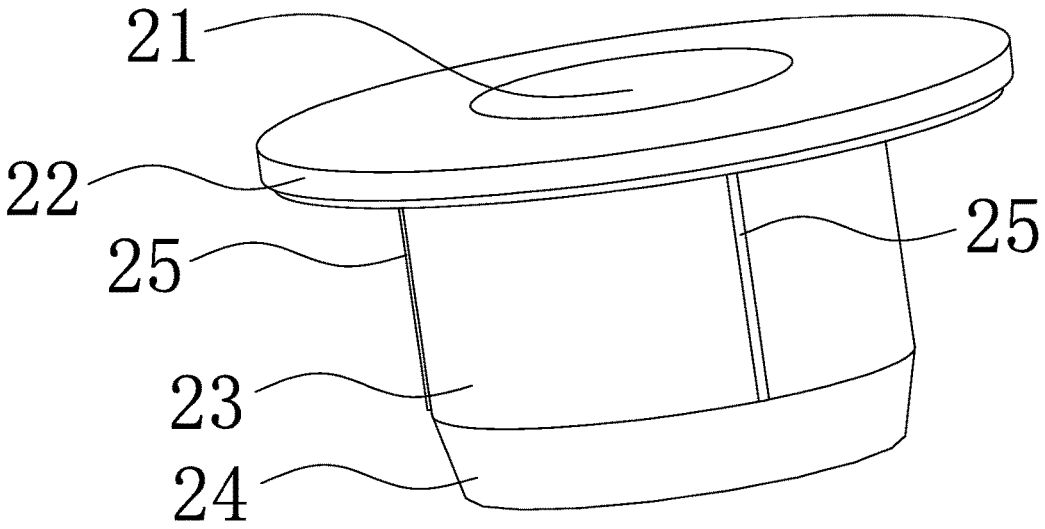
FIG. 4 is a structure diagram of an upper bushing according to the present invention.

As shown in FIG. 1 and FIG. 4, a through hole for the pushrod to pass through is formed on the yoke plate 4, an upper bushing 9 is fixed inside the through hole, an upper guide hole 21 running from top to bottom is formed on the upper bushing 9, and the pushrod is in smooth contact with an inner wall of the upper guide hole 21.

As shown in FIG. 4, the upper bushing 9 comprises an upper portion 22, a middle portion 23 and a lower portion 24 of the upper bushing; three convex ribs 25 protruding outward are formed on an external wall of the middle portion 23 of the upper bushing; the convex ribs 25 are arranged longitudinally and are parallel to an axis of the upper bushing 9; the three convex ribs 25 are evenly distributed at intervals on the external wall of the middle portion 23 of the upper bushing along the circumferential direction of the upper bushing. The upper portion 22 of the upper bushing has an annular structure in which the diameter of the upper portion is greater than that of the middle portion 23 thereof. The lower portion 24 of the upper bushing has a frustum structure in which the diameter of its upper end is greater than that of its lower end.

As shown in FIG. 1, a longitudinal cross-section of the axis of the moving iron core 5 is H-shaped; an upper moving iron core cavity 31 is formed at an upper end of the iron moving core 5, and a lower moving iron core cavity 32 is formed at a lower end of the moving iron core 5; the upper moving iron core cavity 31 penetrates through the moving iron core 5 upward, and the lower moving iron core cavity 32 penetrates through the moving iron core 5 downward; there is a pushrod fixing portion between the upper moving iron core cavity 31 and the lower moving iron core cavity 32; and the middle section 2 of the pushrod and the pushrod fixing portion are fixed by threads.

In the present invention, an upper end and a lower end of the pushrod are guided by an upper bushing and a lower bushing, so as to prevent the deflection of the moving iron core fixed with the pushrod and reduce the frictional force during the up-and-down motions of the moving iron core, so that it is easier to push the moving iron core and the pushrod. In the present invention, the up-and-down motion of the moving iron core and the pushrod can become easier while the turns of the coil can be maintained; and the production cost can be reduced when the moving iron core and the pushrod are in normal use.

The invention claimed is:

1. A moving iron core guide mechanism for a high voltage direct current (HVDC) relay, comprising a pushrod, an upper section of the pushrod being located above a yoke plate and fixed with a moving contact assembly, a middle section and a lower section of the pushrod passing through the yoke plate downward, the middle section of the pushrod being fixed with a moving iron core; the moving iron core is located inside a magnetic conductive cylinder of a U-shaped yoke; a lower bushing is fixed inside the magnetic conductive cylinder, and the lower bushing is located below the moving iron core; a lower guide hole running from top to bottom is formed on the lower bushing; and the lower section of the pushrod is constantly fitted inside the lower guide hole of the lower bushing, and the pushrod is in smooth contact with an inner wall of the lower guide hole.

2. The moving iron core guide mechanism for an HVDC relay according to claim 1, characterized in that the lower bushing has a frustum structure in which the diameter of its upper end is greater than that of its lower end; an external diameter of an upper end of the lower bushing is less than an internal diameter of the magnetic conductive cylinder; an external diameter of a lower end of the lower bushing is greater than the internal diameter of the magnetic conductive cylinder; and the lower bushing is fitted inside the magnetic conductive cylinder from bottom to top.

3. The moving iron core guide mechanism for an HVDC relay according to claim 2, characterized in that a hollow cavity is formed in a lower-half portion of the lower bushing, the lower guide hole is communicated with the hollow cavity, and a plurality of longitudinally telescopic chutes are provided on a wall of the hollow cavity.

4. The moving iron core guide mechanism for an HVDC relay according to claim 3, characterized in that the plurality of longitudinally telescopic chutes are evenly distributed at intervals along the circumferential direction of the lower bushing.

5. The moving iron core guide mechanism for an HVDC relay according to claim 1, characterized in that a through hole for the pushrod to pass through is formed on the yoke plate, an upper bushing is fixed inside the through hole, an upper guide hole running from top to bottom is formed on the upper bushing, and the pushrod is in smooth contact with an inner wall of the upper guide hole.

6. The moving iron core guide mechanism for an HVDC relay according to claim 5, characterized in that at least three convex ribs protruding outward are formed on an external wall of the upper bushing, and the convex ribs are arranged in a longitudinal direction and are parallel to an axis of the upper bushing; and the convex ribs are evenly distributed at intervals on the external wall of the upper bushing along the circumferential direction of the upper bushing.

7. The moving iron core guide mechanism for an HVDC relay according to claim 6, characterized in that the upper bushing comprises an upper portion, a middle portion and a lower portion of the upper bushing, the convex ribs are arranged on an external wall of the middle portion of the upper bushing, and the lower portion of the upper bushing has a frustum structure in which the diameter of its upper end is greater than that of its lower end.

8. The moving iron core guide mechanism for an HVDC relay according to claim 7, characterized in that the upper portion of the upper bushing has an annular structure in which the diameter of the upper portion is greater than that of the middle portion thereof.

9. The moving iron core guide mechanism for an HVDC relay according to claim 1, characterized in that a longitudinal cross-section of the axis of the moving iron core is H-shaped; an upper moving iron core cavity is formed at an upper end of the iron moving core, and a lower moving iron core cavity is formed at a lower end of the moving iron core; the upper moving iron core cavity penetrates through the moving iron core upward, and the lower moving iron core cavity penetrates through the moving iron core downward; there is a pushrod fixing portion between the upper moving iron core cavity and the lower moving iron core cavity; and the pushrod and the pushrod fixing portion are fixed by threads.

* * * * *